US006472352B1

(12) United States Patent
Hacias

(10) Patent No.: US 6,472,352 B1
(45) Date of Patent: Oct. 29, 2002

(54) AQUEOUS LUBRICANT AND PROCESS FOR COLD FORMING METAL, WITH IMPROVED FORMED SURFACE QUALITY

(75) Inventor: Kenneth J. Hacias, Sterling Heights, MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/786,241

(22) PCT Filed: Aug. 31, 1998

(86) PCT No.: PCT/US98/17345

§ 371 (c)(1), (2), (4) Date: Feb. 28, 2001

(87) PCT Pub. No.: WO00/12655

PCT Pub. Date: Mar. 9, 2000

(51) Int. Cl.[7] ..... C10M 125/26; C10M 129/16; C10M 129/26

(52) U.S. Cl. ..... 508/155; 508/156; 508/158; 508/160; 508/185; 508/539; 508/579

(58) Field of Search ..... 508/155, 156, 508/158, 160, 185, 539, 579

(56) References Cited

U.S. PATENT DOCUMENTS

| | | | |
|---|---|---|---|
| 4,659,488 | A | 4/1987 | Vinci |
| 5,055,325 | A | 10/1991 | Trivett |
| 5,531,912 | A | 7/1996 | Church et al. |
| 5,547,595 | A | 8/1996 | Hacias |

*Primary Examiner*—Cephia D. Toomer
(74) *Attorney, Agent, or Firm*—Brooks & Kushman P.C.

(57) ABSTRACT

A highly effective solid cold working lubricant may be deposited on a metal surface from an aqueous solution/dispersion that contains ethoxylated alcohols with at least 18 carbon atoms per alcohol and lithium, calcium, and/or sodium salts of fatty acids. Optional preferred ingredients include inorganic boron containing compounds, ethoxylated castor oil, ionomers, and a corrosion inhibitor that includes azoles. No prior conversion coating, such as is generally used under conventional organic soap lubricants, is needed with this type of solid film.

13 Claims, No Drawings

AQUEOUS LUBRICANT AND PROCESS FOR COLD FORMING METAL, WITH IMPROVED FORMED SURFACE QUALITY

This application is a 371 of PTC/US98/17345, filed Aug. 31, 1998.

BACKGROUND OF THE INVENTION

This invention relates to aqueous liquid lubricant compositions suitable for forming a coating containing an organic binder material on metal surfaces that are coated with a layer of the liquid composition and then dried without rinsing, so that the solids content of the aqueous composition forms on the metal surface a solid layer that lubricates the surface during subsequent cold working operations. The solid film thus deposited is protective against mechanical damage during cold working of the underlying metal. The metal surface processed as described above may or may not have other surface layers, such as phosphate or chromate conversion coatings, coatings formed by anodization, complex oxide layers such as those that can be formed with a commercially available product named BONDERITE® 770X from the Henkel Surface Technologies Div. of Henkel Corp., Madison Heights, Mich., or the like, underlying the coating produced on the surface by using this invention. This invention is generally applicable to cold working most metals, especially steel and aluminum alloys.

Many aqueous liquid compositions that form coatings on metal surfaces that protect the metal surface while it is being cold worked are known. The previously most effective ones have generally been zinc, calcium, and/or sodium soaps applied over a preceding heavy phosphate conversion coating on steel substrates or over a complex calcium aluminate conversion coating on aluminum substrates. (Normally, a sodium stearate or other sodium soap salt is applied over a zinc phosphate coating or a calcium aluminate coating. Reaction between the sodium soap and the zinc or calcium in the previous conversion coating is believed to result in both zinc or calcium soap and sodium soap layers.) However, this combination is environmentally disadvantageous, especially when used over phosphate coatings, because the liquid compositions used to form phosphate coatings generally contain some types of metal ions, such as those of zinc, nickel, manganese, and/or the like, that are regarded as polluting, and the phosphate ions themselves, which are required in phosphate conversion coating forming liquid compositions, are environmentally undesirable in waste waters because of their promotion of eutrophication of natural bodies of water. Zinc and calcium soaps are substantially insoluble in water, but cause workplace nuisances at best and hazards at worst because they tend to form fine dust particles in the air around sites of cold working processes when used as cold working lubricants.

Various polymer based lubricants have been taught in the art as replacements for the combination of stearates over zinc phosphate conversion coatings, but heretofore none of the polymer based lubricants have proved to be commercially acceptable in all applications. A frequently objectionable feature of commercial use of prior polymeric lubricants is the presence of scratches on the surface of the cold worked article A major object of this invention is to provide lubricants and processes that will eliminate or at least reduce the environmental disutilities noted above while still achieving cold working performance that is adequate when compared with the prior art use of phosphate conversion coatings followed by zinc soap application. Other alternative or concurrent objects are to reduce total energy and/or other costs of cold forming operations, particularly by reducing process related waste of objects being cold worked, more particularly because of rejection for scratched surfaces, and/or by achieving higher production rates per unit time. Still another alternative or concurrent object is to provide a lubricant satisfactory for extruding under the more severe conditions in current commercial practice.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, throughout this description, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ by chemical reactions specified in the description, and does not necessarily preclude other chemical interactions among the constituents of a mixture once mixed; specification of materials in ionic form additionally implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its grammatical variations may be applied to elemental, ionic, and any other chemical species defined by number and type of atoms present, as well as to compounds with well defined molecules.

BRIEF SUMMARY OF THE INVENTION

It has been found that a lubricant composition comprising, preferably consisting essentially of, or more preferably consisting of, a combination of;

(A) a component selected from the group consisting of ethoxylated straight chain aliphatic alcohol molecules, wherein the initial alcohol molecules have a single—OH moiety and at least 18 carbon atoms; and (B) a component selected from the group consisting of lithium salts, sodium salts, and calcium salts of fatty organic acids; and, optionally but preferably, (C) a component selected from the group consisting of inorganic boron containing acids and salts thereof; and, optionally, one or more of the following components:

(D) a component selected from the group consisting of condensation products of ethylene oxide and/or propylene oxide with triglycerides of fatty acids that include moieties condensable with ethylene oxide and/or propylene oxide;

(E) a component of at least partially neutralized copolymers of (i) an alkene that contains no carboxyl or carboxylate group and (ii) a comonomer that is an organic acid including the moiety C═C—COOH, such at least partially neutralized copolymers of organic acids often being denoted in the art generally and hereinbelow as "ionomers";

(F) a component of organic corrosion inhibitors that are not part of any of immediately previously recited components (A) through (E);

(G) a component of surfactant molecules that are not part of any of immediately previously recited components (A) through (F); and (H) a component of antifoam agent molecules that are not part of any of previously immediately recited components (A) through (G) effectively achieves at least one of the objects of the invention as stated above.

It has also been found that a liquid composition comprising water and the following dissolved, dispersed, or both dissolved and dispersed components: (A) a component of ethoxylated straight chain aliphatic alcohol molecules, wherein the ethoxylated straight chain aliphatic alcohol molecules are produced by condensing ethylene oxide with aliphatic mono alcohols that have a single —OH moiety and at least 18 carbon atoms per molecule; and (B) a component selected from the group consisting of lithium salts, sodium salts, and calcium salts, all of said salts being salts of fatty organic acids, wherein:

component (A) is selected from ethoxylated straight chain aliphatic alcohol molecules in which:

oxyethylene moieties constitute from about 20 to about 80% of the total mass of the ethoxylated alcohol molecules;

in component (B), there is an average number of from about 14 to about 26 carbon atoms per molecule of salt; and there is also present a dissolved component (C) that is selected from the group consisting of metaboric acid, orthoboric acid, and alkali metal and ammonium salts of metaboric and orthoboric acids and of tetraboric acid, and optionally, there is also present a dissolved, dispersed, or both dissolved and dispersed component (D) that is selected from the group consisting of condensation products of ethylene oxide, propylene oxide, or both ethylene and propylene oxides with triglycerides of fatty acids that include moieties condensable with ethylene oxide and/or propylene oxide;

there is also present a dissolved, dispersed, or both dissolved and dispersed component (E) of at least partially neutralized copolymers of (i) an alkene that contains no carboxyl or carboxylate group and (ii) a comonomer that is an organic acid including the moiety C═C—COOH, there is a total concentration of components (A) and (E) that is at least 2.0% of the total composition;

there is a concentration of component (B) that has a ratio to the total concentration of components (A) and (E) that is at least 0.04:1.0;

component (C) contains a concentration of boron that has a ratio to the total concentration of components (A) and (E) that is at least 0.011:1.0;

there is a concentration of component (D) that has a. ratio to the total concentration of components (A) and (E) that is at least 0.05:1.0; and there is a concentration of component (E) that has a ratio to the concentration of component (A) that is at least 0.3:1.0;

effectively achieves at least one of the objectives of the invention as stated above.

DETAILED DESCRIPTION OF THE INVENTION

For various reasons, almost always including at least a cost saving from elimination of an unnecessary ingredient, it is preferred that a composition according to this invention should be largely free from various materials often used in prior art compositions. In particular, compositions according to this invention in most instances preferably do not contain, with increasing preference in the order given, and with independent preference for each component named, more than 5, 4, 3, 2, 1, 0.5, 0.25, 0.12, 0.06, 0.03, 0.015, 0.007, 0.003, 0.001, 0.0005, 0.0002, or 0.0001% of each of (i) hydrocarbons, (ii) fatty oils of natural origin that have not been modified by chemical reaction from their naturally occurring form, (iii) other ester oils and greases that are liquid at 25° C., (iv) metal salts of fatty acids, (v) hexavalent chromium, (vi) nickel cations, (vii) cobalt cations, (viii) copper cations, (ix) manganese in any ionic form, (x) graphite, (xi) molybdenum sulfide, (xii) copolymers of styrene and maleic moieties, (xiii) oxidized polyethylene, (xiv) urethane polymers and copolymers, (xv) alkoxylates of Guerbet alcohols, and (xvi) polyoxyalkylene polymers not containing an end group having at least 17 carbon atoms in a chain without any intervening carbon-oxygen bonds. (For purposes of this description, the tern "maleic moiety" is defined as a portion of a polymer chain that conforms to one of the following general chemical formulas:

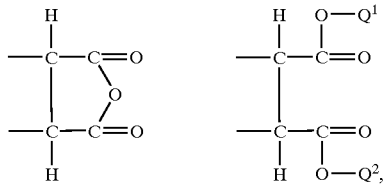

wherein each of $Q^1$ and $Q^2$, which may be the same or different, is selected from the group consisting of hydrogen, alkali metal, ammonium, and substituted ammonium cations.) For possible constituents (xii)–(xvi) as noted above, it is independently preferred that the ratio of the concentration in a composition according to the invention of each of these possible constituents to the concentration of necessary constituent (A) as noted above is, with increasing preference in the order given, not more than 2, 1.5, 1.0, 0.9, 0.8, 0.7, 0.6, 0.5, 0.4, 0.3, 0.2, 0.15, 0.10, 0.07, 0.05, 0.03, 0.02, 0.01, 0.007, 0.005, 0.003, or 0.002. However, all the preferences stated in this paragraph are subordinated to the explicit descriptions of specific materials herein as a necessary, preferred, or optional constituent of a composition according to this invention, so that a material specifically described as necessary, optional, or preferred may be present in a composition according to this invention even if it is a member of some larger class that is unpreferred as noted earlier in this paragraph.

The absolute concentrations of the various necessary, preferable, and optional ingredients in aqueous working or concentrate compositions according to the invention are not at all narrowly limited, and the preferences for concentrations of their predominant constituents are largely determined by the viscosity for both working and concentrate compositions. In a concentrate composition, the concentration of non-volatile ingredients preferably is as high as can be effectively utilized by the equipment available for removing the concentrate from its container and mixing the concentrate composition with water, and sometimes other materials, to form a working composition. In a working composition itself, the preferred viscosity is one that will form an at least temporarily adherent liquid film, on a substrate coated with the working composition, that when dried will contain the preferred amounts of non-volatile lubricant constituents; These preferred amounts vary widely with the exact choice of substrate and cold working conditions, but can readily be determined with minimal experimentation by those skilled in the art. The numerical preferences stated below are believed to be correct for most uses but should be regarded only as general guidelines for exceptional uses.

In a working aqueous composition according to the invention, the combined concentrations of components (A) and (E), if the latter is present, or the concentration of component (A) if component (E) is not present, preferably is at least, with increasing preference in the order given, 1.0, 2.0, 3.0, 4.0, 5.0, 6.0, 7.0, or 7.5%. There is no known technical disadvantage, although there is obviously a possible economic disadvantage, to a concentration of component (A) of at least as much as 15%.

The molecules of components (A) preferably have a chemical structure that can be produced by condensing ethylene oxide with primary, most preferably straight chain, aliphatic monoalcohols that have, with increasing preference in the order given, at least 18, 25, 30, 35, 40, 43, 46 or 48 carbon atoms per molecule and independently, with increasing preference in the order given, not more than 65, 60, 57, 55, 52, or 51 carbon atoms per molecule. Independently, these actual or hypothetical precursor aliphatic alcohols preferably have not functional groups other than the single—OH moiety, and, optionally but less preferably, also fluoro and/or chloro moieties. Independently, it is preferred that the molecules of ethoxylated alcohols used in a composition according to this invention contain, with increasing preference in the order given, at least 20, 30, 35, 40, 43, 47, or 49% and independently preferably contain, with increasing preference in the order given, not more than 80, 70, 62, 57, 54, or 51%, of their total mass in the oxyethylene units.

In component (B), the anions preferably contain a number of carbon atoms in each anion that is at least, with increasing preference in the order given, 10, 12, 14, 16, or 18 and independently preferably is not more than, with increasing preference in the order given, 40, 35, 30, 26, 24, 22, or 20. The number of carbon atoms over the whole of component (B) will be averaged and therefore will not necessarily be integral, as will the number for each molecule, but the preferences for the average are the same as for the individual anions within the number of significant figures stated. Independently, salts of saturated acids and those without functional groups other than the necessary carboxylate group are preferred, to minimize susceptibility to degradation upon storage in contact with the ambient natural atmosphere. For both economy and good performance, salts of commercial stearic acid, which usually contains at least a few percent of palmitic acid also, and may contain small amounts of other fatty acids, is most preferred.

The cations in component (B) may be sodium, lithium, or calcium. The cations more preferably are lithium and/or calcium and still more preferably are a mixture of both lithium and calcium in a molar ratio for lithium to calcium that is at least, with increasing preference in the order given, 0.2:1.0, 0.4:1.0, 0.6:1.0, 0.70:1.0, 0.80:1.0, 0.85:1.0, 0.90:1.0, or 0.95:1.0 and independently preferably is not more than, with increasing preference in the order given, 5:1.0, 3.0:1.0, 2.5:1.0, 2.0:1.0, 1.7:1.0, 1.4:1.0, or 1.1:1.0. Independently, total component (B) preferably has a ratio to a total of components (A) and (E), if the latter optional component is present, or to component (A) if component (E) is not present, that is at least, with increasing preference in the order given, 0.02:1.0, 0.04:1.0, 0.06:1.0, 0.08:1.0, 0.10:1.0, 0.12:1.0, or 0.14:1.0 and independently preferably is not more than, with increasing preference in the order given, 2.0:1.0, 1.5:1.0, 1.0:1.0, 0.8:1.0, 0.6:1.0, 0.4:1.0, or 0.2:1.0.

Component (C) is preferably selected from the group consisting of metaboric acid (i.e., $HBO_2$), orthoboric acid ($H_3BO_3$), and alkali metal and ammonium salts of metaboric and orthoboric acids and of the hypothetical tetraboric acid (i.e., $H_2B_4O_7$). More preferably, component (C) is selected from orthoboric acid, salts of tetraboric acid, and salts of orthoboric acid; most preferably a mixture of orthoboric acid and tetraborate anions and, optionally, orthoborate anions is used, and in such a mixture the molar ratio of the total of orthoborate anions (if any) and of orthoboric acid to tetraborate anions preferably is, with increasing preference in the order given, at least 1.0:1.0, 2.0:1.0, 3.0:1.0, 3.5:1.0, 4.0:1.0, 4.5:1.0, 5.0:1.0, 5.4:1.0, 5.7:1.0, 5.9:1.0, or 6.0:1.0 and independently preferably is, with increasing preference in the order given, not more than 20:1.0, 15:1.0,12:1.0, 10:1.0, 9:1.0, 8.0:1.0, 7.5:1.0, 7.0:1.0, 6.7:1.0, 6.4:1.0, or 6.1:1.0. Independently, the ratio of the total amount of boron in component (C) to the total of component (E), if any, and of component (A) preferably is, with increasing preference in the order given, not less than 0.002:1.0, 0.005:1.0, 0.007:1.0, 0.009:1.0, 0.011:1.0, 0.013:1.0, 0.015:1.0, 0.017:1.0, 0.019:1.0, 0.021:1.0, 0.023:1.0, 0.027:1.0, 0.030:1.0, 0.035:1.0, 0.040:1.0, 0.045:1.0, or 0.050:1.0 and independently preferably is not more than 1.0:1.0, 0.5:1.0, 0.3:1.0, 0.20:1.0, 0.17:1.0, 0.14:1.0, 0.11:1.0, 0.100:1.0, 0.090:1.0, 0.085:1.0, 0.080:1.0, 0.075:1.0, 0.070:1.0, 0.065:1.0, 0.060:1.0, 0.055:1.0, or 0.052:1.0.

The presence in a composition according to the invention of optional alkoxylated triglyceride component (D) is preferred. When component (D) is present in a composition according to the invention, the amount of it preferably has a ratio to the total amount of components (A) and (E) in the same composition that is at least, with increasing preference in the order given, 0.05:1.0, 0.10:1.0, 0.20:1.0, 0.30:1.0, 0.35:1.0, or 0.38:1.0 and independently preferably is not more than, with increasing preference in the order given, 2.0:1.0, 1.0:1.0, 0.90:1.0, 0.70:1.0, 0.60:1.0, 0.55:1.0, 0.50:1.0, or 0.45:1.0.

Independently of its concentration, component (D) is preferably, at least for reasons of economy, selected from materials made by condensing alkylene oxide molecules with one of the naturally available fat or oil triglyceride molecule mixtures, most preferably with castor oil; independently, only ethylene oxide preferably is condensed with the triglyceride used to make component (D), and the amount of ethylene oxide preferably is such as to result in a hydrophile-lipophile balance for component (D) as a whole that is at least, with increasing preference in the order given, 4, 6, 8, 10.0, 10.5, 11.0, or 11.5 and independently preferably is not more than, with increasing preference in the order given, 20, 18, 16, 14, 13.0, 12.5, or 12.0.

The presence in a composition according to the invention of optional ionomer component (E) is also preferred. When component (E) is present, the amount of it present preferably has a ratio to the amount of component (A) in the same composition that is at least, with increasing preference in the order given, 0.1:1.0, 0.3:1.0, 0.5:1.0, 0.7:1.0, 0.9:1.0, or 1.05:1.0 and independently preferably is not more than, with increasing preference in the order given, 5:1.0, 3:1.0, 2.0:1.0, 1.8:1.0, 1.6:1.0, 1.4:1.0, or 1.2:1.0.

Independently of the amount of component (E), an alkene molecule polymerized to make a molecule of component (E) preferably is selected from the group consisting of ethene (more commonly called "ethylene"), propene, 2-methyl propene, and 1- and 2-butenes; more preferably it is ethene or propene, most preferably ethene. For the unsaturated organic acid comonomer to make component (E), acrylic acid is most preferred, and methacrylic acid and other homologs of acrylic acid, i.e., molecules differing from acrylic acid by the addition of one or more —$CH_2$— groups, with not more than six, preferably not more than four, carbon atoms per molecule are next most preferred. The fraction of the mass of the polymer made up of alkene residues preferably is, with increasing preference in the order given, not less than 1, 2, 4, 15, 30, 40, 50, 55, 60, 65, 70, 75, 80, or 84%; independently, the fraction of the mass of the polymer made up of alkene residues preferably is, with increasing preference in the order given, not more than 99, 97, 95, 92, 90, 89, 87, or 86%. Independently, the fraction of the mass of the polymer made up of acrylic acid and/or acrylate residues preferably is, with increasing preference in the order given, not less than 1, 2, 4, 6, 8, 10, 11, 12, 13, or 14%; independently, the fraction of the mass of the polymer made up of acrylic acid and/or 1S acrylate residues preferably is, with increasing preference in the order given, not more than 50, 40, 35, 30, 25, 20, 18, or 16%.

Normally, commercially available polymers in latex form are preferred for component (E); a variety of such commercial products are available. Such products normally contain small amounts of surfactants for stabilizing the polymers in suspension; these surfactants normally have no adverse effect on-compositions according to this invention.

The counterions for the neutralized acrylic acid units in the polymers of component (E) are preferably selected from the group consisting of magnesium, calcium, zinc, and alkali metal ions; more preferably zinc, magnesium, and calcium; most preferably calcium.

Aqueous compositions containing ethoxylated alcohols sometimes stain or otherwise discolor metal surfaces exposed to them. If this is undesirable, it can generally be prevented by including in the working composition a suitable corrosion inhibitor as an optional component (F). A particularly preferred component (F) comprises, more preferably consists essentially of, or still more preferably consists of:

(F.1) a primary inhibitor component selected from the group consisting of non-sulfur-containing organic azole compounds, preferably organic triazoles, more preferably benzotriazole and/or tolyltriazole; and (F.2) a secondary inhibitor component selected from the group consisting of organic azoles that also contain mercapto moieties, preferably mercaptobenzothiazole or mercaptobenzimidazole.

With this preferred corrosion inhibitor, the concentration of component (F.1) in a working aqueous liquid composition according to this invention preferably is, with increasing preference in the order given, not less than 0.10, 0.20, 0.30, 0.40, 0.50, 0.60, 0.70, 0.80, 0.90, or 1.00 part per thousand (hereinafter usually abbreviated "ppt") of the total composition and independently, primarily for reasons of economy, preferably is, with increasing preference in the order given, not more than 20, 10, 5.0, 4.0, 3.0, or 2.0 ppt. For a concentrate, these concentrations should be increased to correspond to the expected dilution factor when the concentrate is used to make a working composition.

Independently, as already noted above, it is preferred for component (F.1) to be selected from benzotriazole and tolyltriazole, and in fact a mixture of these two is more preferred than either of them alone. The amount of each of benzotriazole and tolyltriazole in a composition according to the invention, expressed as a percentage of the total of component (F.1), preferably is, with increasing preference in the order given, independently for each of these two triazoles, not less than 5, 10, 15, 20, 25, 30, 35, 38, 41, 43, 45, 47, 48, or 49% and independently preferably is, with increasing preference in the order given, not more than 95, 90, 85, 80, 75, 70, 65, 62, 59, 57, 55, 53, 52, or 51%. These ratios, unlike the concentration preferences stated above, apply exactly to concentrates as well as to working compositions.

When present, the concentration of component (F.2) in a composition according to this invention preferably has a ratio to the concentration of component (F.1) in the same composition that preferably is, with increasing preference in the order given, not less than 0.001:1, 0.002:1, 0.004:1, 0.007:1, 0.015:1.0, 0.030:1.0, 0.040:1.0, 0.045:1.0, 0.050:1.0, 0.053:1.0, 0.056:1.0, or 0.059:1.0 and independently preferably is, with increasing preference in the order given, not more than 2:1, 1:1, 0.5:1, 0.3:1, 0.2:1, 0.15:1.0, 0.10:1.0, 0.080:1.00, 0.070:1.00, 0.067:1.00; 0.065:1.00, 0.63:1.00, or 0.061:1.00.

Optional components (G) and (H) as described above are not generally needed in a composition according to the invention and therefore are preferably omitted in such instances. However, in unusual instances, a wetting agent may be needed to promote uniform application of a liquid composition according to the invention to a substrate, and/or an antifoam agent may be needed to prevent excessive foaming during some part of a process. In any such instances, suitable material for these purposes can be readily selected by those skilled in the art.

The pH of working compositions according to this invention preferably is, with increasing preference in the order given, not less than 3, 4, 5, 6, 7, 7.3, 7.5, 7.7, 7.8, 7.9, or 8.0 and independently preferably is, with increasing preference in the order given, not more than 11, 10, 9.7, 9.4, 9.1, 9.0, 8.9, 8.8, 8.7, 8.6, or 8.5. If necessary to obtain a pH within the preferred range, alkaline or acid materials may be added to the other ingredients of a composition according to the invention as specified above. Normally, addition of alkaline materials to the other ingredients specified above will be needed in order to obtain the most preferred pH values for a working composition according to the invention, and sodium hydroxide is normally preferred as the alkaline material because it is effective and relatively inexpensive. However, other soluble alkali and alkaline earth metal hydroxides, ammonia, mono-, di- and tri-ethanol amines, and dimethyl- and diethyl-ethanol amines are also suitable for raising the pH if needed to bring it into a preferred range.

The lubricating solid coatings of the present invention are formed by coating a metal surface with a liquid layer of a working aqueous composition of the present invention and then drying into place on the metal surface all non-volatile components that are dissolved, dispersed, or both dissolved or dispersed in the liquid layer coated on the metal surface. The specific areal density (also often called "add-on weight [or mass]") of a composition according to this invention, after application from a liquid composition to the metal surface and drying into place on the liquid-coated treated surface of the solid constituents of the liquid coating thus applied, preferably is, with increasing preference in the order given, at least 0.5, 1.0, 1.5, 2.0, 2.5, 3.0, 3.5, 4.0, 4.5, 5.0, 5.5, 6.0, 6.5, or 7.0 grams of dried lubricating composition per square meter of surface (this unit of areal density or add-on weight being hereinafter usually abbreviated as "$g/m^2$"). Substantially larger amounts than this may be used without any technical disadvantage, but the specific areal density independently preferably is, with increasing preference in the order given, not more than 100, 80, 75, 70, 65, 60, 55, 50, 45, 40, or 35 g/m$^2$, and if maximum economy is desired more preferably is, with increasing preference in the order given, not more than 30, 25, 20, 15, 10, or 9.0 g/m$^2$.

Generally, in order to speed the drying process and possibly to promote some favorable chemical interaction among the nonvolatile components of a working composition according to this invention, it is preferred to expose the liquid coating formed in a process according to this invention to heat in the course of, or after, drying this liquid coating. The maximum temperature to which the coating is exposed preferably is, with increasing preference in the order given, not less than 30, 40, 50, 60, or 70° C. and independently preferably is, with increasing preference in the order given, not more than 180, 160, 150, 140, 130, or 120° C. Independently, the melting point of component (A) in the composition should not be exceeded; for the most preferred examples of component (A), the melting point is about 115° C. The time during which the coating is exposed to the maximum temperature used to dry it preferably is, with increasing preference in the order given, not less than 3, 5, 7, 10, 12, 14, 16, 17, 18, 19, or 20 minutes (hereinafter usually abbreviated "min") and independently preferably is, with increasing preference in the order given, not more than 90, 80, 70, 60, 55, 50, or 45 min. However, the process may also be satisfactorily applied with only drying in the ambient atmosphere, without any elevated temperature, particularly if the working treatment composition is applied while at a temperature that is at least, with increasing preference in the order given, 50, 60, 68, or 72° C.

At least for reasons of economy, a lubricant composition according to the invention preferably is used on a metal substrate that does not have any intermediate coating. However, a composition according to the invention can also be used over an underlying conversion coating layer formed on the metal substrate. The conversion coating may be formed by methods known per se in the art.

The practice of this invention may be further appreciated by consideration of the following, non-limiting, working examples, and the benefits of the invention may be further appreciated by reference to the comparison examples.

EXAMPLE AND COMPARISON EXAMPLE 1

In this group, the substrates were cylindrical steel tubes with outside diameters ranging from 5 to 25 centimeters and wall thicknesses ranging from 0.6 to 3 centimeters. The tubes were made of one of the alloys having American Society for Testing and Materials type numbers 1026, ST52C, and 4130 and were reduced in cross-sectional area during drawing by percentages ranging from 2 to 35%. A commercial drawing operation was used for the testing, enabling the testing of a very large total surface area of tubes with a mass of over 350 tonnes.

Concentrate Example and Comparison Example 1 had the compositions shown in Table 1 below, identical in ingredients other than water except for the presence of lithium stearate in the Example according to the invention. The ethoxylated alcohol used was obtained commercially from Petrolite Corporation under their name UNITHOX™ 750, which is reported by its supplier to consist of products of reaction between ethylene oxide and straight chain primary alcohols with an average carbon number of 50, in relative amounts such that about 50% of the mass of the products consists of poly(oxyethylene) residues from the ethylene oxide molecules reacted and the hydroxyl groups present in the reacted alcohol molecules, the remainder of the product mass being alkyl moieties derived from the alcohol moieties reacted.

The tubes were conventionally cleaned and pickled, then coated with a working composition consisting of a solution in water containing from about 20 to about 33% of one of the concentrates shown in Table 1. The coated tubes were then dried and baked

TABLE 1

| Ingredient | Concentration in Grains Per Liter of Ingredient in: Comparison Example Concentrate 1 | Example Concentrate 1 |
|---|---|---|
| Ethoxylated alcohol | 96 | 96 |
| Boric acid | 24 | 24 |
| Sodium tetraborate decahydrate | 24 | 24 |
| Sodium hydroxide | 3.6 | 3.6 |
| 2-Mercaptobenzimidazole | 0.3 | 0.3 |
| Tolyltriazole | 2.5 | 2.5 |
| Benzotriazole | 2.5 | 2.5 |
| Lithium stearate | 0 | 14 |
| Water | Balance | Balance |

for 30 minutes in a tube dryer maintained at 104 to 116° C. before being drawn. After being drawn, the tubes were examined for surface quality according to normal commercial standards. The rejection rate was about 10% overall for tubes lubricated with dried residues of working compositions made from Comparison Example Concentrate 1. For tubes lubricated with dried residues of working compositions made from Example Concentrate 1,the rejection rate was only about 0.5%.

EXAMPLE AND COMPARISON EXAMPLE GROUP 2

In this group, the substrates were aluminum slugs that, after being lubricated, are extruded into automobile air bag propellant canisters. Four working compositions were prepared with the ingredients shown in Table 2 below.

The substrate slugs were conventionally cleaned according to a PARCO® Cleaner 703 process, directions and chemicals for which are commercially available from the Henkel Surface Technologies Div. of Henkel Corp., Madison Heights, Mich., then were conventionally deoxidized in 20% by mass nitric acid solution in water, and then were coated with one of the working compositions listed in Table 2, or with a slightly diluted working composition made from one of those listed in Table 2,in order to obtain a dry coating weight in a range from 7 to 9 grams per square meter of surface coated. The working compositions were maintained at 74° C. during use, and after coating the slugs were allowed to dry spontaneously in the ambient natural atmosphere before being extruded, all under the same conditions. The quality of extrusion was determined by examining the inside and outside surfaces of the extruded canisters for scratches.

TABLE 2

| Ingredient | Percent by Weight of Ingredient in: Comparison Example 2 | Example 2.1 | Example 2.2 | Example 2.3 |
|---|---|---|---|---|
| Sodium Hydroxide | 0.65 | 0.65 | 0.70 | 0.70 |
| Boric Acid | 1.7 | 1.7 | 2.1 | 2.1 |
| Borax | 0.84 | 0.84 | 2.1 | 2.1 |

TABLE 2-continued

| Ingredient | Percent by Weight of Ingredient in: Comparison Example 2 | Example 2.1 | Example 2.2 | Example 2.3 |
|---|---|---|---|---|
| DK100 ™ defoamer | 0 | 0 | 0.03 | 0 |
| ZONYL ™ FSN100 surfactant | 0 | 0 | 0.14 | 0 |
| UNITHOX ™ D300 latex | 27 | 27 | 15.3 | 11 |
| ACqua ™ 250 ionomer | 25 | 25 | 21.4 | 21 |
| Lithium stearate | 0 | 1.6 | 0.7 | 0.7 |
| Calcium stearate | 0 | 0 | 1.4 | 1.4 |
| ETHOX ™ C030 suffactant | 0 | 0 | 0 | 2.8 |
| Water | Balance | Balance | Balance | Balance |

Notes For Table 2

DK100® defoamer was obtained commercially from Genese Polymers Corp. and was reported by its supplier to consist primarily of aliphatic hydrocarbons; ZONYL® FSN 100 surfactant was obtained commercially from Du Pont and described by its suppler as a fluorinated nonionic surfactant; UNITHOX® D300 latex was commercially supplied by Petrolite Corp., Tulsa, Okla., USA, and is reported by its supplier to be a dispersion in water of a condensation product of aliphatic monohydroxy primary alcohols with an average number of 50 carbon atoms per molecule with an approximately equal mass of ethylene oxide, with a solids content of 23.5±0.5%, ACqua® 250 ionomer was obtained commercially from Allied Signal Corp. and was reported by its supplier to contain 25% solids of a calcium neutralized copolymer of acrylic acid and ethylene in which about 15% of the mass of the copolymer is made up of residues of acrylic acid; ETHOX® C030 surfactant was obtained commercially from Ethox Corp. and was reported by its supplier to consist of ethoxylated castor oil with a hydrophile-lipophile balance of 11.8; and "borax" means $Na_2B_4O_7 \cdot 10H_2O$.

Results are Shown in Table 3.

TABLE 3

| Percent of Substrates Showing Scratches When Lubricated with: | Comparison Example 2 | Example 2.1 | Example 2.2 | Example 2.3 |
|---|---|---|---|---|
| Scratches On Inside | 90 | 50 | 10 | 0 |
| Scratches On Outside | 80 | 50 | 0 | 10 |

The examples according to the invention clearly give better lubrication performance than the comparison example.

The invention claimed is:

1. A liquid composition suitable for applying to metal substrates a lubricating layer for cold working the metal substrates after drying the liquid composition on the metal substrates, said liquid composition comprising water and the following dissolved, dispersed, or both dissolved and dispersed components:

(A) a component of ethoxylated straight chain aliphatic alcohol molecules, wherein the ethoxylated straight chain aliphatic alcohol molecules are produced by condensing ethylene oxide with aliphatic monoalcohols that have a single —OH moiety and at least 18 carbon atoms per molecule;

(B) a component selected from the group consisting of lithium salts, sodium salts, and calcium salts, all of said salts being salts of fatty organic acids, wherein:

component (A) is selected from ethoxylated straight chain aliphatic alcohol molecules in which:

oxyethylene moieties constitute from about 20 to about 80% of the total mass of the ethoxylated alcohol molecules;

in component (B), there is an average number of from about 14 to about 26 carbon atoms per molecule of salt;

there is also present a dissolved component (C) that is selected from the group consisting of metaboric acid, orthoboric acid, and alkali metal and ammonium salts of metaboric and orthoboric acids and of tetraboric acid; and there is also present a dissolved, dispersed, or both dissolved and dispersed component (D) that is selected from the group consisting of condensation products of ethylene oxide, propylene oxide, or both ethylene and propylene oxides with triglycerides of fatty acids that include moieties condensable with ethylene oxide and/or propylene oxide.

2. The composition according to claim 1 wherein there is also present a dissolved, dispersed, or both dissolved and dispersed component (E) of at least partially neutralized copolymers of (i) an alkene that contains no carboxyl or carboxylate group and (ii) a comonomer that is an organic acid including the moiety C═C—COOH, there is a total concentration of components (A) and (E) that is at least 2.0% of the total composition;

there is a concentration of component (B) that has a ratio to the total concentration of components (A) and (E) that is at least 0.04:1.0;

component (C) contains a concentration of boron that has a ratio to the total concentration of components (A) and (E) that is at least 0.011:1.0;

there is a concentration of component (D) that has a ratio to the total concentration of components (A) and (E) that is at least 0.05:1.0; and there is a concentration of component (E) that has a ratio to the concentration of component (A) that is at least 0.3:1.0.

3. A composition according to claim 2 wherein:

there is a total concentration of components (A) and (E) that is from about 4.0 to about 15% of the total composition;

there is a concentration of component (B) that has a ratio to the total concentration of components (A) and (E) that is from about 0.06:1.0 to about 0.8:1.0;

component (C) contains a concentration of boron that has a ratio to the total concentration of components (A) and (E) that is from about 0.021:1.0 to about 0.3:1.0;

there is a concentration of component (D) that has a ratio to the total concentration of components (A) and (E) that is from about 0.10:1.0 to about 1.0:1.0; and there is a concentration of component (E) that has a ratio to the concentration of component (A) that is from about 0.3:1.0 to about 3:1.0.

4. A process of providing a metal surface with a solid lubricant layer suitable for subsequent cold working, said process comprising steps of:

(I) coating the metal surface with a liquid layer of a composition according to claim 1; and (II) drying into place on the metal surface all non-volatile components that are dissolved, dispersed, or both dissolved and dispersed in the liquid layer formed in step (I), so as to form on the metal surface a lubricating solid coating.

5. A process of providing a metal surface with a solid lubricant layer suitable for subsequent cold working, said process comprising steps of:

(I) coating the metal surface with a liquid layer of a composition according to claim 3; and (II) drying into place on the metal surface all non-volatile components that are dissolved, dispersed, or both dissolved and dispersed in the liquid layer formed in step (I), so as to form on the metal surface a lubricating solid coating.

6. A process according to claim 4, wherein the lubricating solid coating formed in step (II) has a mass per unit area of surface coated that is from about 4.0 to about 15 $g/m^2$.

7. A liquid composition suitable for applying to metal substrates a lubricating layer for cold working the metal substrates after drying the liquid composition on the metal substrates, said liquid composition comprising water and the following dissolved, dispersed, or both dissolved and dispersed components:

(A) a component of ethoxylated straight chain aliphatic alcohol molecules, wherein the ethoxylated straight chain aliphatic alcohol molecules are produced by condensing ethylene oxide with aliphatic monoalcohols that have a single —OH moiety and at least 25 carbon atoms per molecule; and (B) a component selected from the group consisting of lithium salts, sodium salts, and calcium salts, all of said salts being salts of fatty organic acids, wherein:

component (A) is selected from ethoxylated straight chain aliphatic alcohol molecules in which:

oxyethylene moieties constitute from about 40 to about 62% of the total mass of the ethoxylated alcohol molecules;

in component (B), there is an average number of from about 16 to about 20 carbon atoms per molecule of salt, and the cations in the salt are a mixture of lithium and calcium in a molar ratio of lithium to calcium that is from about 0.70:1.0 to about 1.4:1.0; and there is also present a dissolved component (C) that is a mixture of:

a concentration of orthoboric acid and a concentration of alkali metal tetraborate salts and a concentration of salts selected from the group consisting of alkali metal orthoborates, armonium orthoborates, and mixtures of both alkali metal and ammonium orthoborates, in which mixture there is a molar ratio of a sum of:

the stoichiometric equivalent as orthoborate anions of any orthoborate salts present in the composition and the concentration of orthoboric acid to tetraborate anions that is from about 3.5:1.0 to about 10:1.0;

there is also present a dissolved, dispersed, or both dissolved and dispersed component (D) that is selected from molecules resulting from condensing ethylene oxide with castor oil, said component (D) overall having a hydrophile-lipophile-balance value that is from about 10.0 to about 13.0;

there is also present a dissolved, dispersed, or both dissolved and dispersed component (E) of at least partially neutralized copolymers of ethene and acrylic acid, said copolymers before neutralization having a mass of ethene residues that is from about 70 to about 90% of the colpolymers and after neutralization having cations selected from the group consisting of zinc, magnesium, and calcium.

8. A composition according to claim 7, wherein:

there is a total concentration of components (A) and (E) that is from about 5.0 to about 15% of the total composition;

there is a concentration of component (B) that has a ratio to the total concentration of components (A) and (E) that is from about 0.06:1.0 to about 0.8:1.0;

component (C) contains a concentration of boron that has a ratio to the total concentration of components (A) and (E) that is from about 0.035:1.0 to about 0.070:1.0;

there is a concentration of component (D) that has a ratio to the total concentration of components (A) and (E) that is from about 0.30:1.0 to about 0.60:1.0;

there is a concentration of component (E) that has a ratio to the concentration of component (A) that is from about 0.7:1.0 to about 1.6:1.0;

there is also present a corrosion inhibitor component (F) selected from the group consisting of sulfur-free organic triazoles, organic azoles that include a mercapto moiety, or a mixture of both sulfur-free triazoles and organic azoles that include a mercapto moiety.

9. A process of providing a metal surface with a solid lubricant layer suitable for subsequent cold working, said process comprising steps of:

(I) coating the metal surface with a liquid layer of a composition according to claim 7; and (II) drying into place on the metal surface all non-volatile components that are dissolved, dispersed, or both dissolved and dispersed in the liquid layer formed in step (I), so as to form on the metal surface a lubricating solid coating.

10. A process of providing a metal surface with a solid lubricant layer suitable for subsequent cold working, said process comprising steps of:

(I) coating the metal surface with a liquid layer of a composition according to claim 8; and (II) drying into place on the metal surface all non-volatile components that are dissolved, dispersed, or both dissolved and dispersed in the liquid layer formed in step (I), so as to form on the metal surface a lubricating solid coating.

11. A process according to claim 10, wherein the lubricating solid coating formed in step (II) has a mass per unit area of surface coated that is from about 4.0 to about 15 $g/m^2$.

12. A liquid composition suitable for applying to metal substrates a lubricating layer for cold working the metal substrates after drying the liquid composition on the metal substrates, said liquid composition comprising water and the following dissolved, dispersed, or both dissolved and dispersed components:

(A) a component selected from the group consisting of ethoxylated straight chain aliphatic alcohol molecules, wherein the ethoxylated straight chain aliphatic alcohol molecules are produced by condensing ethylene oxide with aliphatic monoalcohols that have a single —OH moiety and at least 18 carbon atoms per molecule; and (B) a component selected from the group consisting of lithium salts, sodium salts, and calcium salts of fatty organic acids;

(C) a component selected from the group consisting of inorganic boron containing acids and salts thereof;

(D) a component selected from the group consisting of condensation products of ethylene oxide and/or propylene oxide with triglycerides of fatty acids that include moieties condensable with ethylene oxide and/or propylene oxide;

(E) a component of at least partially neutralized copolymers of (i) an alkene that contains no carboxyl or carboxylate group and (ii) a comonomer that is an organic acid including the moiety C═C—COOH;

(F) component of organic corrosion inhibitors that are not part of any of immediately previously recited components (A) through (E);

(G) a component of surfactant molecules that are not part of any of immediately previously recited components (A) through (F); and (H) a component of antifoam agent molecules that are not part of any of previously immediately recited components (A) through (G).

13. The composition according to claim 12 wherein the liquid composition consists essentially of water and the following dissolved, dispersed, or both dissolved and dispersed components:

(A) a component selected from the group consisting of ethoxylated straight chain aliphatic alcohol molecules, wherein the ethoxylated straight chain aliphatic alcohol molecules are produced by condensing ethylene oxide with aliphatic monoalcohols that have a single —OH moiety and at least 18 carbon atoms per molecule; and (B) a component selected from the group consisting of lithium salts, sodium salts, and calcium salts of fatty organic acids;

(C) a component selected from the group consisting of inorganic boron containing acids and salts thereof;

(D) a component selected from the group consisting of condensation products of ethylene oxide and/or propylene oxide with triglycerides of fatty acids that include moieties condensable with ethylene oxide and/or propylene oxide and/or propylene oxide;

(E) a component of at least partially neutralized copolymers of (i) an alkene that contains no carboxyl or carboxylate group and (ii) a comonomer that is an organic acid including the moiety C═C—COOH;

(F) a component of organic corrosion inhibitors that are not part of any of immediately previously recited components (A) through (E);

(G) a component of surfactant molecules that are not part of any of immediately previously recited components (A) through (F); and (H) a component of antifoam agent molecules that are not part of any of previously immediately recited components (A) through (G).

* * * * *